US011518554B2

(12) United States Patent
Kawashima

(10) Patent No.: US 11,518,554 B2
(45) Date of Patent: Dec. 6, 2022

(54) AUTOMATIC FILLING AND PACKAGING DEVICE

(71) Applicant: ORION MACHINERY CO., LTD., Sagamihara (JP)

(72) Inventor: Hiroe Kawashima, Sagamihara (JP)

(73) Assignee: ORION MACHINERY CO., LTD., Sagamihara (JP)

( * ) Notice: Subject to any disclaimer, the term of this patent is extended or adjusted under 35 U.S.C. 154(b) by 0 days.

(21) Appl. No.: 17/764,604

(22) PCT Filed: Nov. 2, 2020

(86) PCT No.: PCT/JP2020/041088

§ 371 (c)(1),
(2) Date: Mar. 29, 2022

(87) PCT Pub. No.: WO2021/131328

PCT Pub. Date: Jul. 1, 2021

(65) Prior Publication Data

US 2022/0348371 A1 Nov. 3, 2022

(30) Foreign Application Priority Data

Dec. 24, 2019 (JP) ..... JP2019-232984

(51) Int. Cl.
*B65B 5/04* (2006.01)
*B65B 5/06* (2006.01)
(Continued)

(52) U.S. Cl.
CPC ..... *B65B 5/045* (2013.01); *B65B 5/067* (2013.01); *B65B 7/04* (2013.01); *B65B 7/06* (2013.01);
(Continued)

(58) Field of Classification Search
CPC ..... B65B 5/045; B65B 5/067; B65B 7/04; B65B 7/06; B65B 35/20; B65B 35/40; B65B 43/50; B65B 49/08; B65B 51/146
(Continued)

(56) References Cited

U.S. PATENT DOCUMENTS 3,877,562 A * 4/1975 Shaw ..... B65B 5/067 198/429
4,183,194 A * 1/1980 Lucke ..... B65B 5/067 53/374.6
2011/0036055 A1* 2/2011 Shibagaki ..... B65B 5/067 53/266.1

FOREIGN PATENT DOCUMENTS

JP 53-120992 A 10/1978
JP 63-11054 Y2 4/1988
(Continued)

OTHER PUBLICATIONS

International Search Report, issued in PCT/JP2020/041088, dated Dec. 28, 2020.
(Continued)

*Primary Examiner* — Stephen F. Gerrity
(74) *Attorney, Agent, or Firm* — Birch, Stewart, Kolasch & Birch, LLP

(57) ABSTRACT

An object is to provide an automatic filling and packaging device which enhances the efficiency of packaging work and which suppresses the occurrence of defective products to achieve satisfactory yield.
In an automatic filling and packaging device, a locating means, a pair of upper gusset nails, a pair of intermediate gusset nails, a pair of lower gusset nails, and a blade-equipped sealing device are formed into a unit as a unit main body, and the unit main body and the pusher member are formed to be able to freely move close to and apart from each other. In this way, as compared with a conventional
(Continued)

automatic filling and packaging device, it is possible to reduce the total time in which one article to be packaged is filled into one packaging bag and then the opening end portion thereof is sealed, with the result that it is possible to enhance the efficiency of packaging work.

7 Claims, 9 Drawing Sheets

(51) Int. Cl.

| | |
|---|---|
| ***B65B 7/04*** | (2006.01) |
| ***B65B 35/20*** | (2006.01) |
| ***B65B 49/08*** | (2006.01) |
| ***B65B 51/14*** | (2006.01) |
| ***B65B 43/50*** | (2006.01) |
| ***B65B 7/06*** | (2006.01) |

(52) U.S. Cl.
CPC ..... *B65B 35/20* (2013.01); *B65B 43/50* (2013.01); *B65B 49/08* (2013.01); *B65B 51/146* (2013.01)

(58) Field of Classification Search
USPC ..... 53/570, 255, 258, 284.7, 372.2, 372.7
See application file for complete search history.

(56) References Cited

FOREIGN PATENT DOCUMENTS

| | | | |
|---|---|---|---|
| JP | 9-77003 | A | 3/1997 |
| JP | 2004-238005 | A | 8/2004 |
| JP | 2013-86850 | A | 5/2013 |
| JP | 2017-190186 | A | 10/2017 |

OTHER PUBLICATIONS

Written Opinion of the International Searching Authority, issued in PCT/JP2020/041088, dated Dec. 28, 2020.

* cited by examiner

FIG. 8A
FIG. 8B
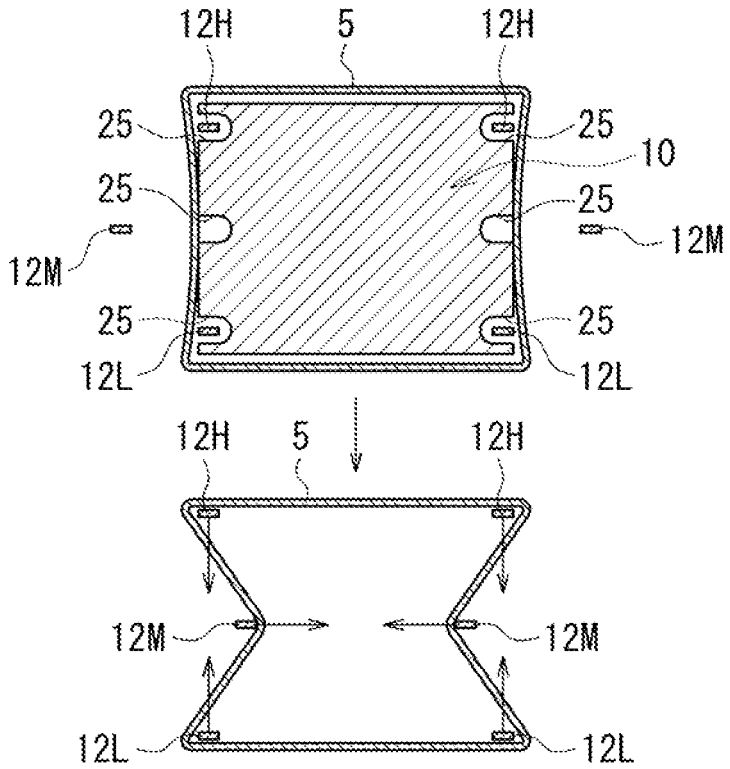
FIG. 9
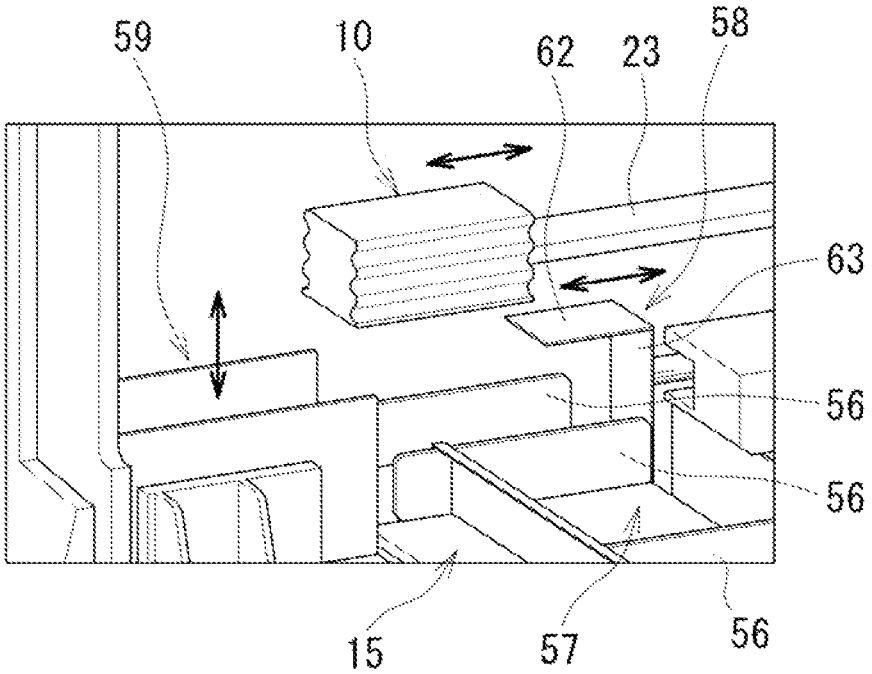

AUTOMATIC FILLING AND PACKAGING DEVICE

TECHNICAL FIELD

The present invention relates to an automatic filling and packaging device for packaging, for example, an article to be packaged such as a paper diaper or a sanitary napkin into a packaging bag.

BACKGROUND ART

In general, an automatic filling and packaging device substantially includes: a pusher member which fills an article to be packaged from the opening end portion of a packaging bag while pushing it; an ejection stopper which locates the article to be packaged in a state where the article to be packaged is filled into the packaging bag; a gusset forming means which is provided in the pusher member to fold the opening end portion of the packaging bag into a gusset shape; and a blade-equipped sealing device which seals the portion folded with the gusset forming means into the gusset shape while pressing in an up/down direction and heating the folded portion and which cuts an extra portion. The pusher member is formed to freely move in a longitudinal direction. The gusset forming means (see Patent Literature 1) is provided in a side surface of the pusher member, and substantially includes: a V-shaped concave portion which extends in the longitudinal direction; a plurality of suction holes which are spaced in the bottom portion of the V-shaped concave portion in the longitudinal direction; and an air suction source such as a blower which is connected to the suction holes.

In order to fill the article to be packaged into the packaging bag, the pusher member is first used to fill the article to be packaged so as to push the article to be packaged into the packaging bag, and such a state is located with the ejection stopper. Then, when the pusher member is pulled out from the packaging bag, the air suction source is used to suck air from the suction holes so as to remove air inside the packaging bag, and, by outside air pressure, the opening end portion of the packaging bag is brought into intimate contact with the V-shaped concave portion provided in the side surface of the pusher member to be folded into the gusset shape. Then, a pair of upper and lower sealing members in the blade-equipped sealing device are brought close to each other to perform heat sealing such that the opening end portion is folded in the up/down direction, a pair of upper and lower cutter members in the blade-equipped sealing device are brought close to each other to intersect each other and thus an extra portion on a tip side is cut from a sealed part. Then, while the blade-equipped sealing device is being opened, the ejection stopper is returned to an initial position, and the packaged article is ejected by drive of an ejection belt along the direction of ejection.

CITATION LIST

Patent Literature

Patent Literature 1: Japanese Examined Utility Model Registration Application Publication No. 63-11054

SUMMARY OF INVENTION

Technical Problem

However, in the conventional automatic filling and packaging device described above, since the blade-equipped sealing device and the like are restrained in their positions and only the pusher member moves forward and backward, the total time in which one article to be packaged is filled into one packaging bag and then the opening end portion of the packaging bag is sealed is long, with the result that the production speed is limited. When in the conventional automatic filling and packaging, the opening end portion of the packaging bag is folded into the gusset shape, since the suction force of air is used to fold the opening end portion of the packaging bag, variations in the finish thereof are easily produced, with the result that a defective product is produced to lead to poor yield. Hence, it is necessary to improve this problem.

Furthermore, when in the conventional automatic filling and packaging device, the pusher member is pulled out from the packaging bag, since the opening end portion of the packaging bag is folded into the gusset shape and is sealed with the blade-equipped sealing device, it is necessary to increase, when a high-speed operation is performed to enhance the efficiency of packaging work, the speed of movement of the pusher member, the speed of ejection of the article after the opening end portion of the packaging bag is sealed and the like. However, when the speed of movement of the pusher member, the speed of ejection of the article and the like are increased as described above, the time of sealing performed with the blade-equipped sealing device is reduced, and thus a failure in the sealing easily occurs to lead to poor yield. Hence, it is necessary to improve this problem.

A detailed description will be given of the increasing of the speed of ejection of the article described above. In the conventional automatic filling and packaging device, after the packaged article is ejected, while an article to be packaged is being filled into the subsequent packaging bag, sealing is performed in a state where the article to be packaged is located with the ejection stopper, and thereafter the ejection stopper is opened together with the blade-equipped sealing device to eject the article. Hence, in order to increase the speed of ejection of the article, it is important how the speed of ejection of the article is increased. In order to cope with this, it is considered to increase the speed of the ejection belt by drive of a servomotor or to adopt a vacuum belt. However, when the speed of the ejection belt is excessively increased, a fused portion which has just been sealed may be pulled to be opened or, for example, a phenomenon may occur in which the article slides on the ejection belt and in this case, the ejection stopper may be moved down to damage the article, with the result that a large number of defective products are produced to lead to poor yield. Hence, it is necessary to improve this problem.

As described above, in the conventional automatic filling and packaging device, the portions other than the pusher member are restrained in their positions, and the following four steps are performed: a step of opening the blade-equipped sealing device to fill the article to be packaged into the packaging bag; a step of closing the blade-equipped sealing device while folding the opening end portion of the packaging bag into the gusset shape; a step of sealing the portion folded with the blade-equipped sealing device and cutting the extra portion; and a step of returning the ejection stopper to the initial position while opening the blade-equipped sealing device to eject the article. In the conventional automatic filling and packaging device as described above, it is impossible to cope with an increase in the speed and thus it is difficult to enhance the efficiency of the packaging work and moreover, a large number of defective products are produced to lead to poor yield.

The present invention is made in view of the foregoing problems, and an object of the present invention is to provide an automatic filling and packaging device which enhances the efficiency of packaging work and which suppresses the occurrence of defective products to achieve satisfactory yield.

Solution to Problem

In order to solve the problems described above, the present invention provides the invention according to claim 1, and the invention according to claim 1 includes: a pusher member that fills an article to be packaged from an opening end portion of a packaging bag while pushing the article to be packaged; a locating means that locates the article to be packaged in a state where the article to be packaged is filled into the packaging bag with the pusher member; a plurality of gusset nails that fold the opening end portion of the packaging bag into a gusset shape after the article to be packaged is filled into the packaging bag with the pusher member; and a blade-equipped sealing device that cuts an extra portion of the packaging bag on a tip side while sealing the portion folded with the gusset nails into the gusset shape, the locating means, the gusset nails and the blade-equipped sealing device are formed into a unit as a unit main body and the unit main body and the pusher member are formed to be able to freely move close to and apart from each other.

In the invention of aspect 1, in the process in which the unit main body and the pusher member are brought close to and apart from each other, it is possible to perform a series of working steps of filling the article to be packaged into the packaging bag, folding the opening end portion of the packaging bag into the gusset shape and sealing the part thereof. Consequently, as compared with the conventional technique, it is possible to reduce the total time in which one article to be packaged is filled into one packaging bag and then the opening end portion thereof is sealed.

In short, in the invention of aspect 1, three steps, that is, a step of filling the article to be packaged into the packaging bag while the blade-equipped sealing device is opening the packaging bag and locating the article to be packaged in its state, a step of folding the opening end portion of the packaging bag into the gusset shape and a step of sealing the folded part and performing cutting can be performed while the unit main body and the pusher member are moving. Consequently, as compared with the conventional technique, a step of ejecting the article is not included, that is, the step of ejecting the packaged article which includes a large number of uncertain factors for achieving a high-speed operation is separated from the step in which the blade-equipped sealing device is operated, and thus as compared with the conventional technique, it is possible to significantly reduce the total time in which one article to be packaged is filled into one packaging bag and then the opening end portion thereof is sealed, with the result that it is possible to easily cope with an increase in the speed of the operation and to suppress the occurrence of a failure such as a failure in the sealing.

The invention according to aspect 2 is such that, in the invention according to aspect 1, the direction of movement of the unit main body and the direction of movement of the pusher member are on the same line.

In the invention of aspect 2, it is possible to simplify working steps in an automatic filling and packaging device and to increase the speed of production of the automatic filling and packaging device.

The invention according to aspect 3 is such that the invention according to aspect 1 or 2 includes an operation control means. The operation control means performs control such that when the unit main body and the pusher member move close to each other, the article to be packaged is pushed and filled with the pusher member from the opening end portion of the packaging bag whereas when the unit main body and the pusher member move apart from each other, the opening end portion of the packaging bag folded into the gusset shape is sealed with the blade-equipped sealing device while the unit main body is moving backward.

In the invention of claim aspect 3, in particular, since the opening end portion of the packaging bag folded into the gusset shape is sealed with the blade-equipped sealing device while the unit main body is moving backward, even when a high-speed operation is performed, the blade-equipped sealing device can take enough time to perform the sealing, and thus it is possible to suppress the occurrence of a failure in the sealing.

The invention according to aspect 4 is such that, in the invention according to any one of aspects 1 to 3, the outside shape of the pusher member is substantially formed in a shape of a rectangular parallelepiped, and in both side surfaces of the pusher member in a direction in which the pusher member moves forward and backward, clearance grooves that hold the gusset nails are formed in entire areas in the direction in which the pusher member moves forward and backward.

In the invention of aspect 4, while the pusher member is present within the packaging bag, the gusset nails can be inserted into the opening end portion of the packaging bag.

The invention according to aspect 5 is such that the invention according to any one of claims aspects 1 to 4 includes an ejection means that is arranged to overlap the unit main body in an up/down direction when the unit main body moves backward to an initial position and that ejects, from the unit main body, an article in which the article to be packaged is filled into the packaging bag and in which the opening end portion thereof is sealed.

In the invention of aspect 5, when the unit main body moves backward to position, the article retained in the unit main body can easily be moved, by its weight, onto the ejection means. In other words, while the series of working steps described above are being performed, it is possible to separate the packaged article from the unit main body simultaneously in parallel.

The invention according to aspect 6 is such that, in the invention according to aspect 5, the ejection means includes a stopper member that regulates the movement of the article when the unit main body moves forward.

In the invention of aspect 6, when the unit main body moves forward, in synchronization with the forward movement, the article can easily be separated with the stopper member from the unit main body.

The invention according to aspect 7 is such that, in the invention according to any one of aspects 3 to 6, the operation control means includes a control logic that supports, with the gusset nails, the opening end portion of the packaging bag in a substantially rectangular open posture after the pusher member moves forward to fill the article to be packaged into the packaging bag before the pusher member completely moves backward from the packaging bag.

In the invention of aspect 7, the open posture of the opening end portion of the packaging bag can easily be formed into a substantially rectangular shape along the front shape (substantially rectangular shape) of the pusher member, and thus it is easy to use the gusset nails to form and retain the open posture in a substantially rectangular shape.

Advantageous Effects of Invention

In the automatic filling and packaging device according to the present invention, it is possible to enhance the efficiency of packaging work and suppress the occurrence of defective products, with the result that it is possible to achieve satisfactory yield.

BRIEF DESCRIPTION OF DRAWINGS

FIGS. 8A and 8B are diagrams showing, in a stepwise manner, a step of folding the opening end portion of a packaging bag into a gusset shape with the pair of left and right upper gusset nails, the pair of left and right intermediate gusset nails and the pair of left and right lower gusset nails shown in FIG. 7;

FIG. 9 is a schematic perspective view of an article-to-be-packaged supplying means which is adopted in the automatic filling and packaging device according to the embodiment of the present invention;

DESCRIPTION OF EMBODIMENTS

An embodiment of the present invention will be described in detail below with reference to FIGS. 1 to 14. In the following description, in the context that an article to be packaged 4 is filled into a packaging bag 5 and the opening end portion thereof is sealed, the upstream side or the downstream side thereof is mentioned. In the following description, an item in which the article to be packaged 4 is filled into the packaging bag 5 but the opening end portion has not been sealed yet is referred to as a temporarily packaged article 6, and an item in which the article to be packaged 4 is filled into the packaging bag 5, the opening end portion is sealed and the packaging is completed is referred to as an article 7.

Figure 1:
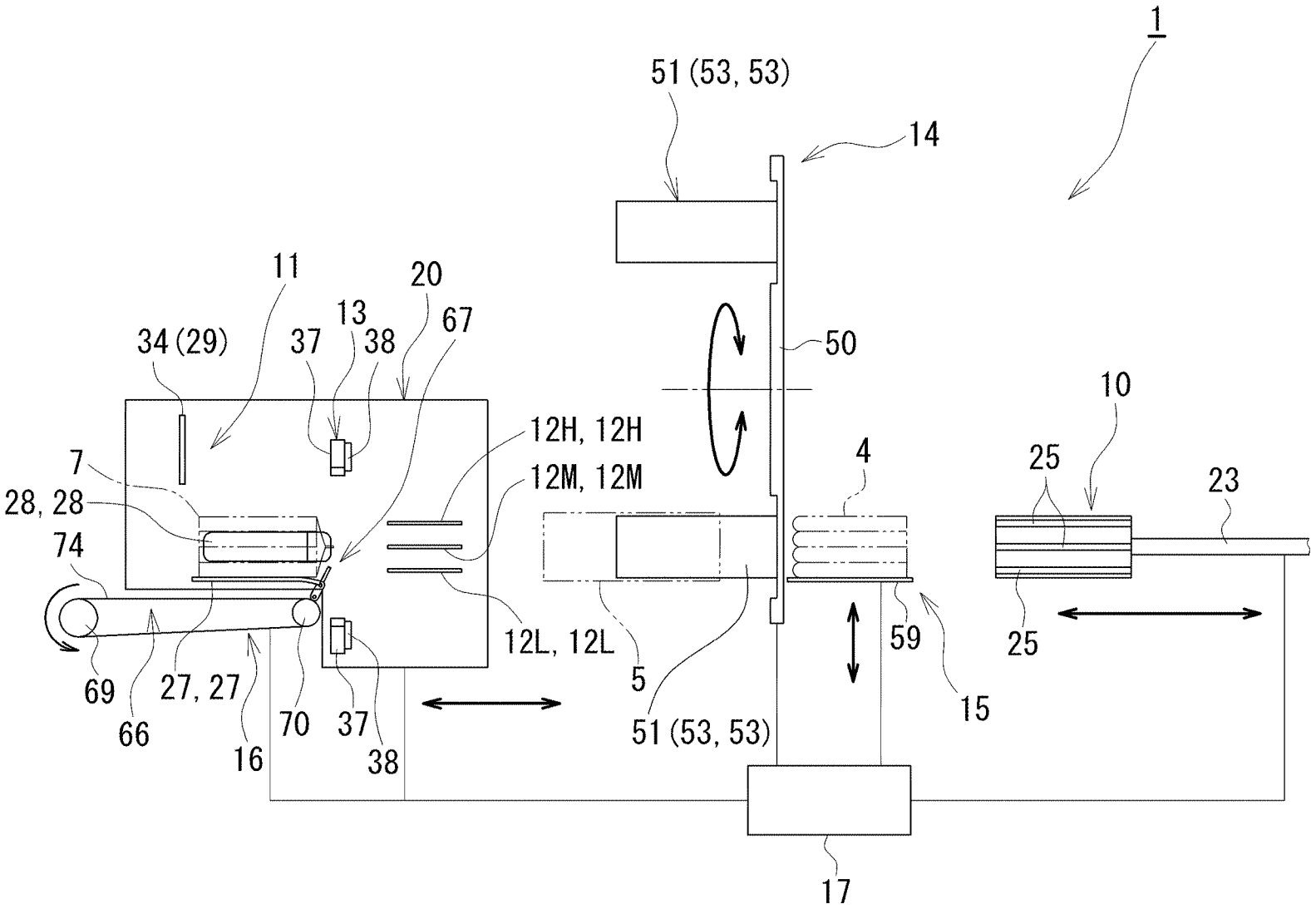
FIG. 1 is a schematic view showing an overall picture of an automatic filling and packaging device according to an embodiment of the present invention.

An automatic filling and packaging device 1 according to the embodiment of the present invention is a device that automatically fills the article to be packaged 4 into the packaging bag 5 having one end portion blocked and the other end portion open from the opening end portion thereof to seal the opening end portion. As shown in FIG. 1, the automatic filling and packaging device 1 according to the embodiment of the present invention substantially includes: a pusher member 10 which fills the article to be packaged 4 from the opening end portion of the packaging bag 5 while pushing the article to be packaged 4; a locating means 11 which locates the article to be packaged 4 in a state where the article to be packaged 4 is filled into the packaging bag 5 with the pusher member 10; a pair of left and right upper gusset nails 12H, 12H, a pair of left and right intermediate gusset nails 12M, 12M, and a pair of left and right lower gusset nails 12L, 12L, which fold, after the article to be packaged 4 is filled into the packaging bag 5 with the pusher member 10, the opening end portion of the packaging bag 5 into a gusset shape; a blade-equipped sealing device 13 that seals the portion folded into the gusset shape with the pair of left and right upper gusset nails 12H, 12H, the pair of left and right intermediate gusset nails 12M, 12M, and the pair of left and right lower gusset nails 12L, 12L, while pressing and heating the folded portion and that cuts an extra portion on a tip side from the sealed part; a bag supplying means 14 which is provided on the upstream side of the pair of left and right upper gusset nails 12H, 12H, the pair of left and right intermediate gusset nails 12M, 12M, and the pair of left and right lower gusset nails 12L, 12L to supply the packaging bag 5; an article-to-be-packaged supplying means 15 which is provided on the upstream side of the bag supplying means 14 to supply the article to be packaged 4; an ejection means 16 which ejects, to the outside, the article 7 in which the article to be packaged 4 is filled into the packaging bag 5 and in which the opening end portion thereof is sealed; and an operation control means 17 which controls the operations of the constituent members described above.

Figure 2:
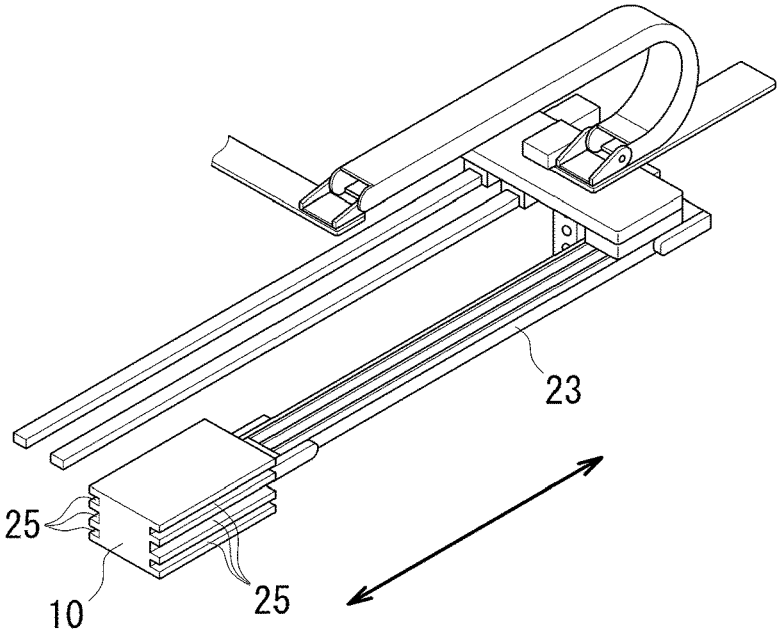
FIG. 2 is a perspective view of a pusher member which is adopted in the automatic filling and packaging device according to the embodiment of the present invention.

Also with reference to FIG. 2, the outside shape of the pusher member 10 is formed in the shape of a rectangular parallelepiped. The front shape of the pusher member 10 is formed substantially in the shape of a rectangle. When the opening end portion of the packaging bag 5 is opened, the front shape takes the shape of its open posture. A plate-shaped slide portion 23 is connected to one end surface of the pusher member 10 in a longitudinal direction. The plate-shaped slide portion 23 has a thin thickness and extends along the longitudinal direction of the pusher member 10. The pusher member 10 is formed to be able to freely move forward and backward along the longitudinal direction by movement of the plate-shaped slide portion 23 caused by the drive of an unillustrated drive device. The drive device is electrically connected to the operation control means 17 to be operated by signals from the operation control means 17.

In both the side surfaces of the pusher member 10 in a direction in which the pusher member 10 moves forward and backward, clearance grooves 25, 25 are formed. The clearance grooves 25, 25 are formed at three places so as to be spaced in an up/down direction. The clearance grooves 25, 25 are formed in the entire areas in the direction in which the pusher member 10 moves forward and backward. The depths of the clearance grooves 25, 25 are the same as each other. In both the side surfaces of the pusher member 10, the pair of left and right upper gusset nails 12H, 12H are respectively held in the clearance grooves 25, 25 in upper portions thereof. In both the side surfaces of the pusher member 10, the pair of left and right lower gusset nails 12L, 12L are respectively held in the clearance grooves 25, 25 in lower portions thereof.

Figure 3:
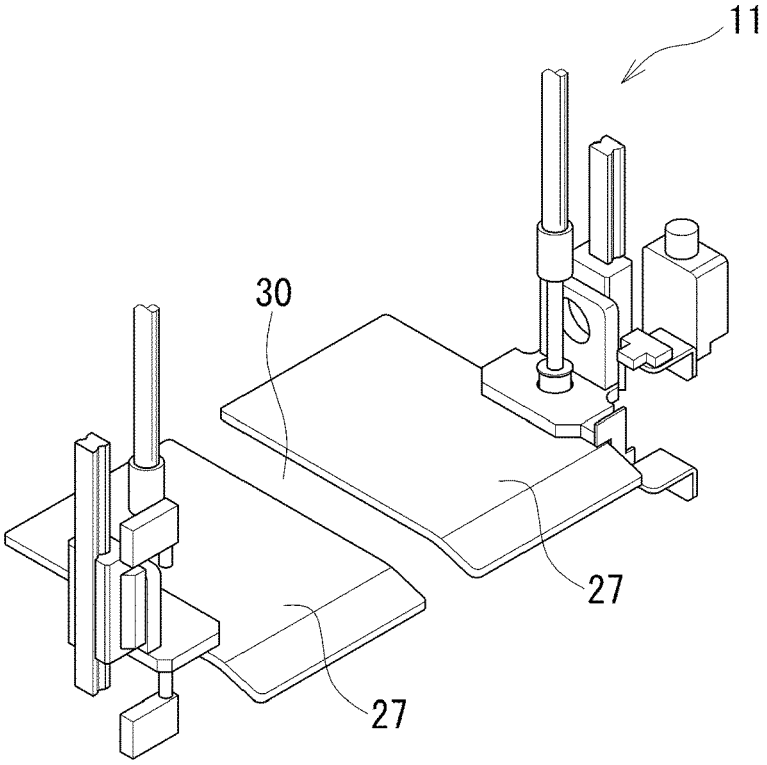
FIG. 3 is a perspective view of a pair of base plates in a locating means which are adopted in the automatic filling and packaging device according to the embodiment of the present invention.
Figure 4:
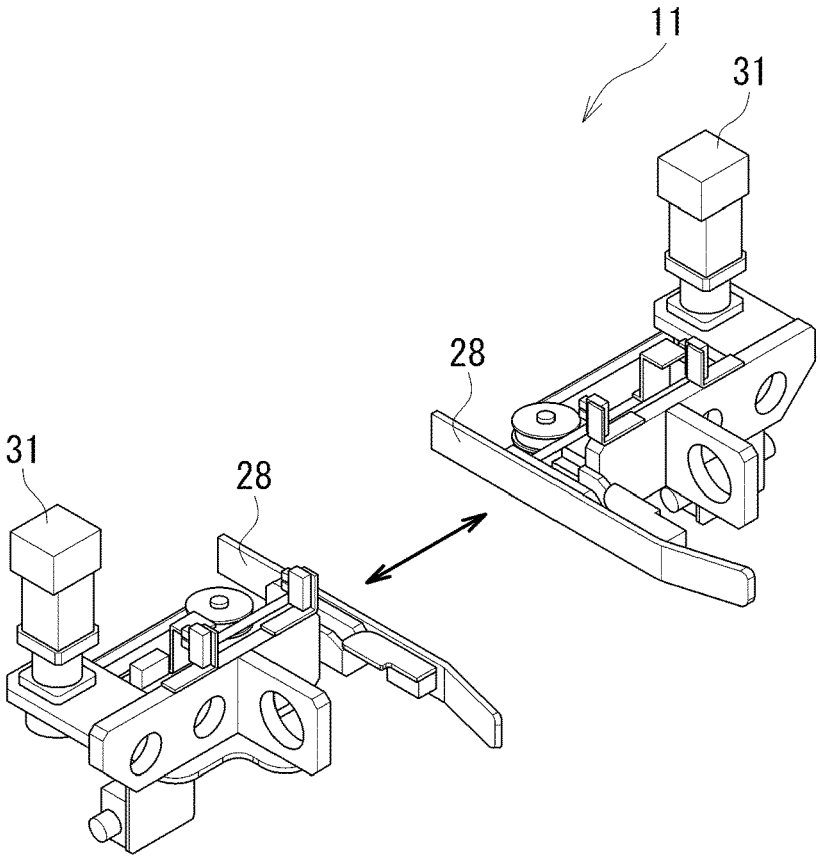
FIG. 4 is a perspective view of a pair of side guide plates in the locating means which are adopted in the automatic filling and packaging device according to the embodiment of the present invention.
Figure 5:
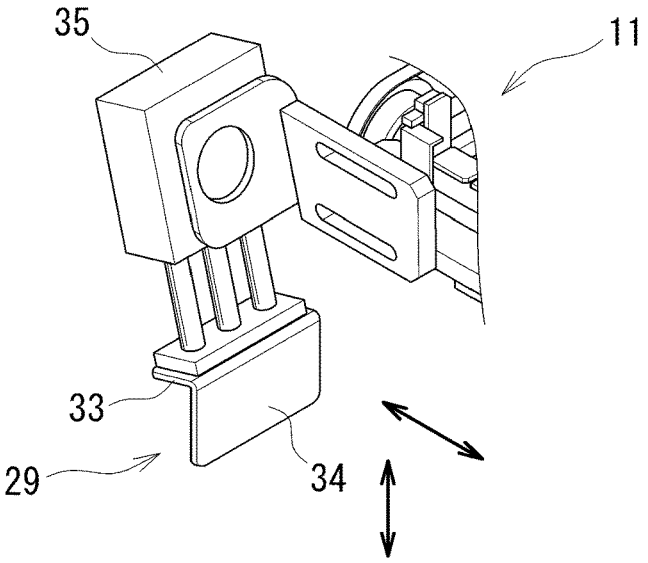
FIG. 5 is a perspective view of a stopper member in the locating means which is adopted in the automatic filling and packaging device according to the embodiment of the present invention.
Figure 6:
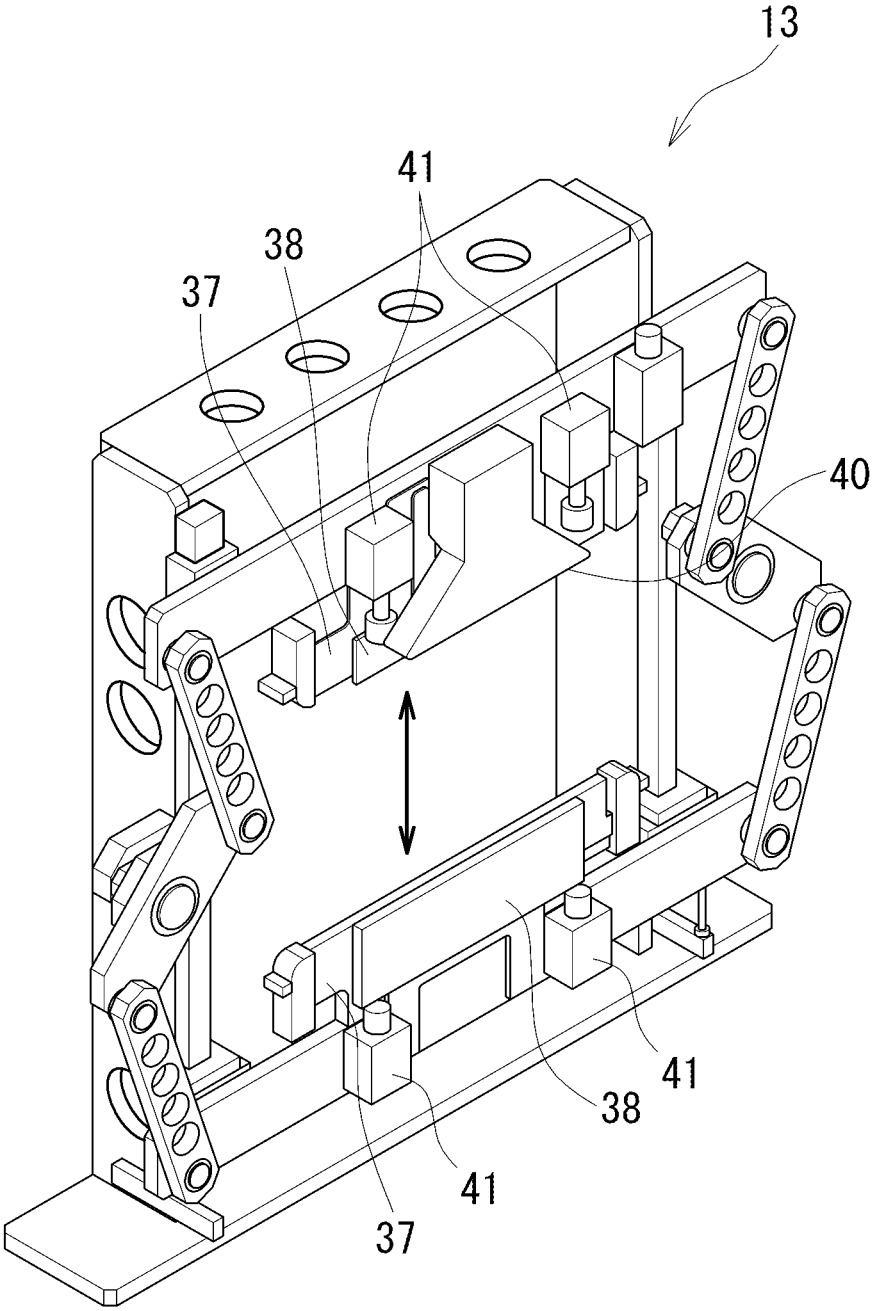
FIG. 6 is a schematic perspective view of a blade-equipped sealing device which is adopted in the automatic filling and packaging device according to the embodiment of the present invention.
Figure 7:
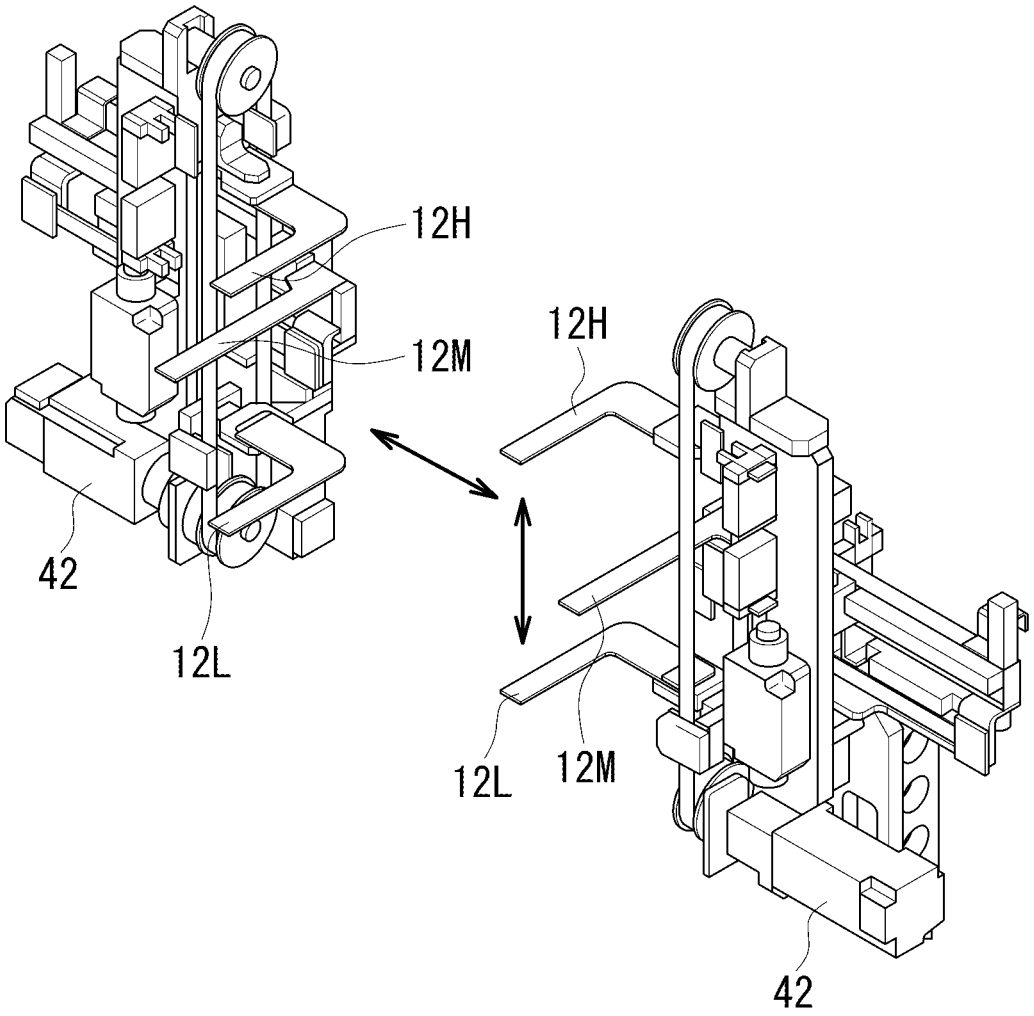
FIG. 7 is a perspective view of a pair of left and right upper gusset nails, a pair of left and right intermediate gusset nails and a pair of left and right lower gusset nails which are adopted in the automatic filling and packaging device according to the embodiment of the present invention.

As shown in FIGS. 3 to 5, also with reference to FIG. 1, the locating means 11 is intended for locating the temporarily packaged article 6 in a predetermined position in the state of the temporarily packaged article 6 where the article to be packaged 4 is pushed and filled into the packaging bag 5 with the pusher member 10 until the opening end portion is sealed with the blade-equipped sealing device 13. The locating means 11 includes: a pair of base plates 27, 27 (see FIG. 3) on which the temporarily packaged article 6 is placed; a pair of side guide plates 28, 28 (see FIG. 4) which locate the temporarily packaged article 6 so as to sandwich the temporarily packaged article 6 between both the side surfaces; and a stopper member 29 (see FIG. 5) which regulates the movement of the temporarily packaged article 6 to the downstream side. As shown in FIG. 3, the base plate 27 is formed substantially in the shape of a rectangle. Between the pair of base plates 27,27, a linear space portion 30 is formed. In the space portion 30, the shaft portion 78 of a stopper member 67 in the ejection means 16 which will be described later is arranged to freely relatively move. The space portion 30 has a width long enough to insert the stopper portion 79 of the stopper member 67 in the ejection means 16 which will be described later. In each of the base plates 27, 27, the end portion on the upstream side extends obliquely downward.

As shown in FIGS. 1 and 4, the pair of side guide plates 28, 28 are provided above the base plates 27, 27 to be spaced so as to stand substantially parallel to each other. As shown in FIG. 4, each of the side guide plates 28 is formed substantially in the shape of a thin long rectangular plate. In each of the guide plates 28, the end portion thereof on the upstream side extends slightly obliquely outward. Consequently, the pair of side guide plates 28, 28 are formed as a whole in the shape of a reverse letter V in plan view such that the distance between the pair of side guide plates 28, 28 is gradually increased toward the upstream side. The pair of side guide plates 28, 28 are formed to be able to freely move close to and apart from each other by the drive of servomotors 31 corresponding thereto. The servomotors 31, 31 are electrically connected to the operation control means 17 to be operated by signals from the operation control means 17.

Figure 12:
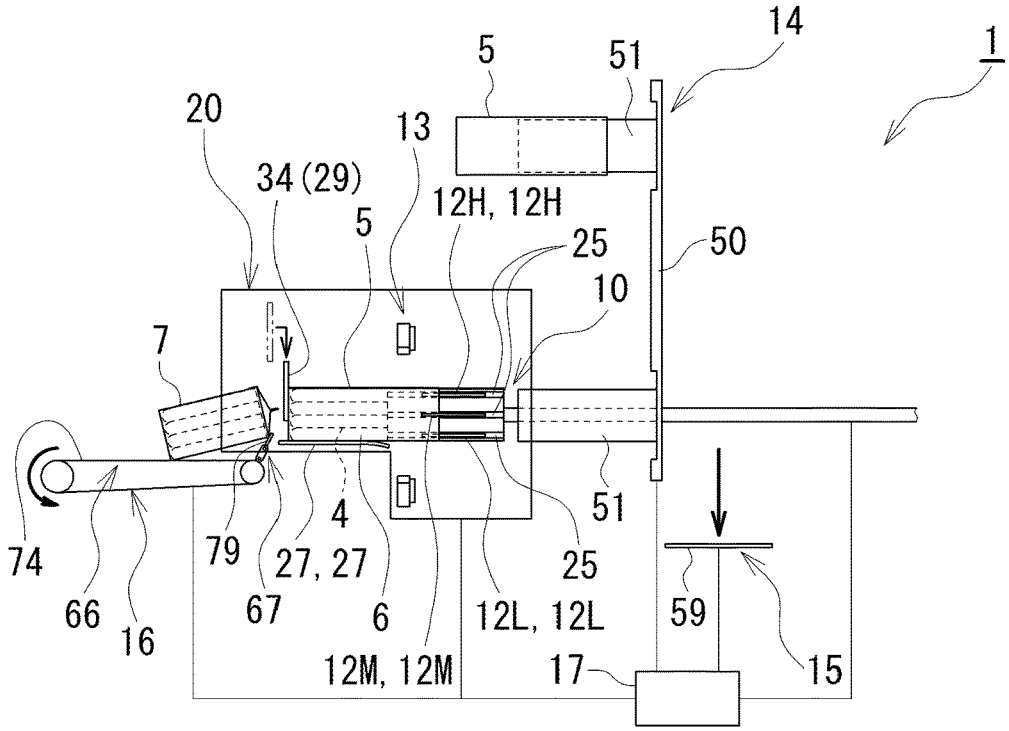
FIG. 12 is a diagram showing, in a stepwise manner, the operation of the automatic filling and packaging device according to the embodiment of the present invention.

As shown in FIGS. 1 and 5, also with reference to FIG. 12, the stopper member 29 is formed in the shape of a letter L and is formed with a substantially rectangular coupling plate-shaped portion 33 which is coupled to a cylinder 35 and a stopper portion 34 which is integrally connected to the coupling plate-shaped portion 33 to make contact with the bottom surface (surface on the downstream side) of the temporarily packaged article 6. The stopper portion 34 is formed substantially in the shape of a rectangle. The stopper member 29 (stopper portion 34) is formed to be able to freely move forward and backward along the up/down direction by the drive of the cylinder 35. A servomotor can be used instead of the cylinder 35. The stopper member 29 (stopper portion 34) is formed to be able to freely move forward and backward, by the drive of an unillustrated drive device, with respect to a unit main body 20 which will be described later along the same direction as the direction in which the pusher member 10 moves forward and backward. The cylinder 35 and the drive device are electrically connected to the operation control means 17 to be operated by signals from the operation control means 17.

In the locating means 11, when the temporarily packaged article 6 is arranged on the pair of base plates 27, the pair of side guide plates 28, 28 move close to each other to support both the side surfaces of the temporarily packaged article 6, and thus the temporarily packaged article 6 is located in the left/right direction. The stopper portion 34 of the stopper member 29 moves downward and to the upstream side to abut on the bottom surface (surface on the downstream side) of the temporarily packaged article 6 on the pair of base plates 27, 27 to regulate the movement of the temporarily packaged article 6 to the downstream side, with the result that the temporarily packaged article 6 is located in the direction in which the temporarily packaged article 6 moves forward.

Then, in the state of the temporarily packaged article 6, until the opening end portion of the packaging bag 5 is sealed with the blade-equipped sealing device 13, the temporarily packaged article 6 is located in a predetermined position on the pair of base plates 27, 27 with the locating means 11, that is, the pair of side guide plates 28, 28 and the stopper portion 34 of the stopper member 29. Thereafter, when the opening end portion of the packaging bag 5 is sealed with the blade-equipped sealing device 13, the pair of side guide plates 28, 28 move apart from each other to separate from both the side surfaces of the article 7. The stopper portion 34 of the stopper member 29 moves upward and to the downstream side to separate from the back surface (surface on the downstream side) of the article 7. Consequently, the location of the article 7 using the locating means 11 is released.

As shown in FIG. 1, the blade-equipped sealing device 13 is arranged on the upstream side of the locating means 11. Also with reference to FIG. 6, the blade-equipped sealing device 13 includes a pair of upper and lower sealing main bodies 37, 37, and a pair of upper and lower cutter members 38, 38, which are provided on the surfaces on the upstream side of the pair of sealing main bodies 37, 37. The pair of upper and lower sealing main bodies 37, 37 are formed to be able to move close to and apart from each other by the drive of an unillustrated drive device. The drive device is electrically connected to the operation control means 17 to be operated by signals from the operation control means 17. Then, the opening end portion of the temporarily packaged article 6 in a state where the opening end portion is folded into the gusset shape can be sealed by being sandwiched between the pair of upper and lower sealing main bodies 37, 37 and being pressed and heated.

The pair of upper and lower cutter members 38, 38 are formed to be able to move close to and apart from each other by the drive of cylinders 41, 41. The cylinders 41, 41 are electrically connected to the operation control means 17 to be operated by signals from the operation control means 17. Then, the pair of upper and lower cutter members 38, 38 are brought close to each other to intersect each other, and thereby can cut the extra portion on the tip side from the sealed part. The blade-equipped sealing device 13 includes a suction nozzle 40 which is coupled to the upper sealing main body 37 and the upper cutter member 38. The suction nozzle 40 is connected to a suction device (unillustrated). In this way, the extra portion on the tip side cut with the pair of upper and lower cutter members 38, 38 can be ejected with the suction nozzle 40 to the outside.

As shown in FIG. 1, on the upstream side of the blade-equipped sealing device 13, the pair of left and right upper gusset nails 12H, 12H, the pair of left and right intermediate gusset nails 12M, 12M and the pair of left and right lower gusset nails 12L, 12L are arranged. Also with reference to FIG. 7, the upper gusset nails 12H, 12H are arranged in an upper portion as the pair of left and right gusset nails. The upper gusset nail 12H is formed by providing laterally a plate member having a predetermined width and a thin thickness. The upper gusset nail 12H extends along the direction of movement of the pusher member 10. The blade-equipped sealing device 13 is arranged on the tip side of the upper gusset nail 12H. The lower gusset nails 12L, 12L are arranged in a lower portion as the pair of left and right gusset nails. The lower gusset nail 12L is formed by providing laterally a plate member having a predetermined width and a thin thickness. The lower gusset nail 12L extends along the direction of movement of the pusher member 10. The blade-equipped sealing device 13 is arranged on the tip side of the lower gusset nail 12L.

The upper gusset nail 12H and the lower gusset nail 12L which are formed as a pair of upper and lower gusset nails are arranged in positions overlapping each other in the up/down direction. The upper gusset nails 12H, 12H and the lower gusset nails 12L, 12L, which are formed as pairs of upper and lower gusset nails are formed to be able to freely move close to and apart from each other by the drive of servomotors 42, 42. The servomotors 42, 42 are electrically connected to the operation control means 17 to be operated by signals from the operation control means 17. The intermediate gusset nails 12M, 12M are arranged as the pair of left and right gusset nails in intermediate positions between the upper gusset nails 12H and the lower gusset nails 12L in the up/down direction. The intermediate gusset nail 12M is formed by providing laterally a plate member having a predetermined width and a thin thickness. The intermediate gusset nail 12M extends along the direction of movement of the pusher member 10. The blade-equipped sealing device 13 is arranged on the tip side of the intermediate gusset nail 12M. The pair of left and right intermediate gusset nails 12M, 12M are formed to be able to freely move close to and apart from each other by the drive of an unillustrated drive device. The drive device is electrically connected to the operation control means 17 to be operated by signals from the operation control means 17.

Then, as shown in FIG. 8A, the pair of left and right upper gusset nails 12H, 12H, and the pair of left and right lower gusset nails 12L, 12L are first inserted into the four corners of the opening end portion of the packaging bag 5. FIG. 8A is a diagram of a state where the pusher member 10 is inserted into the packaging bag 5. Then, the opening end portion of the packaging bag 5 is supported from the inside in a substantially rectangular open posture. Substantially at the same time, the pair of left and right intermediate gusset nails 12M, 12M are arranged in the vicinity of both the side surfaces of the opening end portion which is opened in a substantially rectangular shape and center portions in the up/down direction.

Then, as shown in FIG. 8B, the pair of left and right intermediate gusset nails 12M, 12M move, from the positions described above, close to each other, and the upper gusset nails 12H, 12H and the lower gusset nails 12L, 12L which are formed as the pairs of upper and lower gusset nails are brought close to each other to move to such positions that the upper gusset nails 12H, 12H, and the lower gusset nails 12L, 12L substantially overlap the pair of left and right intermediate gusset nails 12M, 12M along the horizontal direction. Consequently, by the pair of left and right upper gusset nails 12H, 12H, the pair of left and right intermediate gusset nails 12M, 12M, and the pair of left and right lower gusset nails 12L, 12L, the opening end portion of the packaging bag 5 can be folded into the gusset shape.

As shown in FIG. 1, the bag supplying means 14 is arranged on the upstream side of the pair of left and right upper gusset nails 12H, 12H, the pair of left and right intermediate gusset nails 12M, 12M, and the pair of left and right lower gusset nails 12L, 12L. The bag supplying means 14 includes a turning member 50 and a plurality of bag supporting members 51, 51, which are spaced on the surface of the turning member 50 on the upstream side along a circumferential direction. The turning member 50 is alternately turned in forward and reverse directions with a half-revolution pitch by the drive of an unillustrated drive device. The drive device is electrically connected to the operation control means 17 to be operated by signals from the operation control means 17.

A plurality of bag supporting members 51, 51 are spaced in the circumferential direction to protrude from the surface of the turning member 50 on the upstream side toward the unit main body 20 which will be described later. In the present embodiment, the bag supporting members 51, 51 are provided at two places with a pitch of 180°. The bag supporting member 51 supports the packaging bag 5 in a state where the packaging bag 5 is opened. Specifically, the packaging bag 5 is wrapped around the bag supporting member 51 from the opening end portion thereof. The packaging bag 5 is wrapped around the bag supporting member 51 and is opposite the pusher member 10 in a state where the opening end portion is open in a substantially rectangular shape. The bag supporting member 51 is formed by arranging a pair of division supporting members 53, 53 having a U-shaped cross section such that the open sides thereof are opposite each other. Between the pair of division supporting members 53, 53, an opening portion which is substantially rectangular when seen from the front is formed.

The pair of division supporting members 53, 53 are provided to penetrate the turning member 50. Between the pair of division supporting members 53, 53, the pusher member 10 freely moves forward and backward. Consequently, the article to be packaged 4 is pushed by the pusher member 10 to move between the pair of division supporting members 53, 53 toward the unit main body 20 which will be described later. Then, the turning member 50 is turned half a revolution in a forward direction, and thus the bag supporting member 51 described above is located in an upper position. Then, the packaging bag 5 is wrapped around the bag supporting member 51 from the opening end portion with an unillustrated bag fitting means. Then, the turning member 50 is turned half a revolution in a reverse direction, and thus the bag supporting member 51 wrapped with the packaging bag 5 is located in a lower position. In this state, while the pusher member 10 is pushing the article to be packaged 4, the pusher member 10 moves through the turning member 50 inside the bag supporting member 51, and thus the article to be packaged 4 is pushed and filled into the packaging bag 5 to form the temporarily packaged article 6. Thereafter, the temporarily packaged article 6 is placed on the pair of base plates 27, 27 of the locating means 11 in the unit main body 20 which moves close to the pusher member 10.

As shown in FIG. 1, the article-to-be-packaged supplying means 15 is arranged on the upstream side of the bag supplying means 14. Also with reference to FIG. 9, the article-to-be-packaged supplying means 15 includes: a transport conveyer 57 which includes a plurality of partition plates 56, 56 that are spaced to stand; an input pusher member 58 which moves the article to be packaged 4 arranged between the partition plates 56, 56 in the transport conveyer 57 while pushing the article to be packaged 4; and a receiving member 59 which receives the article to be packaged 4 moved by the input pusher member 58. The transport conveyer 57 extends in a direction substantially orthogonal to the direction of movement of the input pusher member 58. The transport conveyer 57 sequentially transports the articles to be packaged 4 between the partition plates 56, 56 to an area in front of the input pusher member 58 at time intervals. A drive device (unillustrated) for the transport conveyer 57 is electrically connected to the operation control means 17 to be operated by signals from the operation control means 17.

The partition plates 56, 56 are spaced to stand on the transport conveyer 57. The articles to be packaged 4 are placed between the partition plates 56, 56. The input pusher member 58 is arranged below the pusher member 10. The input pusher member 58 is formed to be able to freely move forward and backward in the same direction as the pusher member 10 by the drive of an unillustrated drive device. The drive device is electrically connected to the operation control means 17 to be operated by signals from the operation control means 17. The input pusher member 58 includes a substantially rectangular upper plate 62 and a pushing plate 63 which extends downward from an end portion of the upper plate 62.

The receiving member 59 is arranged in a position opposite the direction of movement of the input pusher member 58. The receiving member 59 is formed to be able to freely move forward and backward along the up/down direction by the drive of an unillustrated drive device. The drive device is electrically connected to the operation control means 17 to be operated by signals from the operation control means 17. Then, the article to be packaged 4 placed between the partition plates 56, 56 in the transport conveyer 57 is transported to a position opposite the pushing plate 63 of the input pusher member 58 by the drive of the transport conveyer 57. Then, the input pusher member 58 moves forward, and thus while the upper plate 62 is being located above the article to be packaged 4, the article to be packaged 4 is pushed with the pushing plate 63 into the receiving member 59. Then, the receiving member 59 moves upward by the drive of the drive device, and thus the article to be packaged 4 is supplied to a position opposite the pusher member 10 (see FIG. 1).

As shown in FIG. 1, the locating means 11, the blade-equipped sealing device 13, the pair of left and right upper gusset nails 12H, 12H, the pair of left and right intermediate gusset nails 12M, 12M, and the pair of left and right lower gusset nails 12L, 12L, which are described above are formed into a unit as the unit main body 20 by being coupled to each other with a large number of coupling members, frame members and the like which are not illustrated. The unit main body 20 is formed to be able to move close to and apart from the pusher member 10 in the horizontal direction by the drive of an unillustrated drive device. The drive device is electrically connected to the operation control means 17 to be operated by signals from the operation control means 17. The direction of movement of the unit main body 20 and the direction of movement of the pusher member 10 is on the same line along the horizontal direction.

In the unit main body 20, the locating means 11, the blade-equipped sealing device 13, the pair of left and right upper gusset nails 12H, 12H, the pair of left and right intermediate gusset nails 12M, 12M, and the pair of left and right lower gusset nails 12L, 12L are formed into a unit such that the unit main body 20 can perform, while moving, three steps, that is, a step of filling the article to be packaged 4 into the packaging bag 5 while the blade-equipped sealing device 13 is opening the packaging bag 5 and locating the article to be packaged 4 in its state, a step of folding the opening end portion of the packaging bag 5 into the gusset shape and a step of sealing the folded part and performing cutting. As shown in FIG. 1, the ejection means 16 is provided which ejects the packaged article 7 from the unit main body 20 in a predetermined direction by the movements of the unit main body 20 and the pusher member 10.

Figure 10:
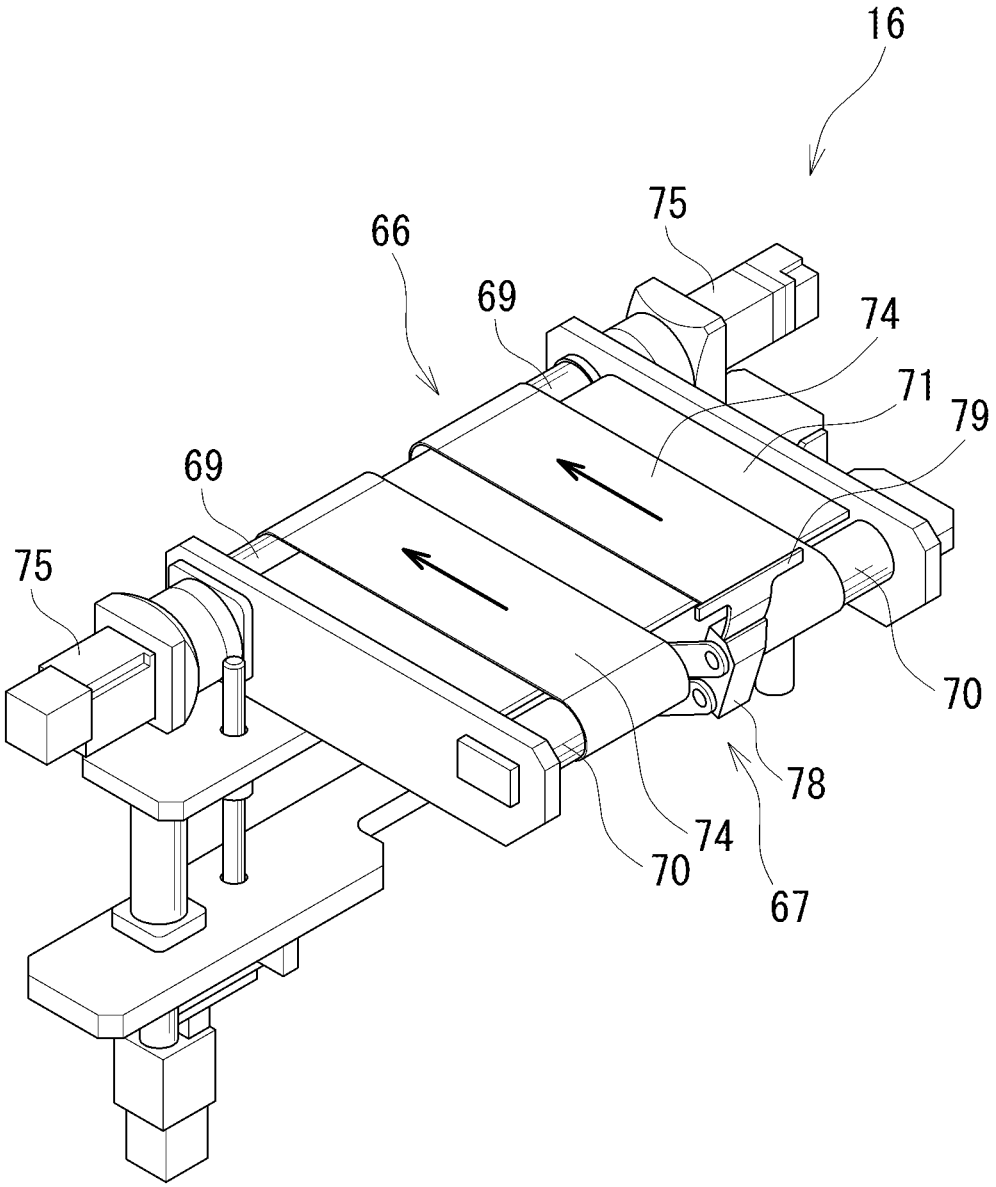
FIG. 10 is a perspective view of an ejection means which is adopted in the automatic filling and packaging device according to the embodiment of the present invention.

As shown in FIGS. 1 and 10, the ejection means 16 includes: an ejection main body 66 which receives the article 7 and ejects it in the predetermined direction; and the stopper member 67 which is provided to be able to appear upward from the end portion of the ejection main body 66 on the upstream side. The ejection main body 66 includes: a pair of drive shafts 69, 69, which are provided on the downstream side; a pair of driven shafts 70, 70, which are provided on the upstream side and are supported to be able to freely rotate; a support stand 71 which is provided between the drive shafts 69, 69, and the driven shafts 70, 70; and ejection belts 74 which are wound around the drive shafts 69, the support stand 71 and the driven shafts 70. The two ejection belts 74, 74 are arranged to be spaced. Reference signs 75 represent servomotors for driving and rotating the drive shafts 69. By the rotation of the drive shafts 69, 69 described above, the ejection belts 74, 74 rotate around the support stand 71. The servomotors 75, 75 are electrically connected to the operation control means 17 to be operated by signals from the operation control means 17.

The ejection belts 74, 74 (drive shafts 69, 69) rotate in a direction in which the article 7 on the ejection belts 74, 74 is separated from the stopper member 67 and is ejected. The stopper member 67 includes the shaft portion 78 and the T-shaped stopper portion 79 which is connected to an end portion of the shaft portion 78. The stopper member 67 is arranged between the pair of driven shafts 70, 70. An unillustrated cylinder is coupled to the shaft portion 78 of the stopper member 67. By the drive of the cylinder described above, the stopper portion 79 of the stopper member 67 can freely appear upward from the support stand 71 of the ejection main body 66. The cylinder is electrically connected to the operation control means 17 to be operated by signals from the operation control means 17. A servomotor can be used instead of the cylinder. As is understood from FIG. 1, when the unit main body 20 moves backward to the initial position, the pair of base plates 27, 27, in the locating means 11 included in the unit main body 20 are arranged immediately above the ejection main body 66 of the ejection means 16.

As described above, the operation control means 17 is electrically connected to the drive devices such as the servomotor and the cylinder which are respectively provided for operating the pusher member 10, the locating means 11, the pair of left and right upper gusset nails 12H, 12H, the pair of left and right intermediate gusset nails 12M, 12M, the pair of left and right lower gusset nails 12L, 12L, the blade-equipped sealing device 13, the bag supplying means 14, the article-to-be-packaged supplying means 15, the ejection means 16 and the unit main body 20. Although not shown in the figure, in the automatic filling and packaging device 1, a large number of detection sensors such as a photoelectric sensor for detecting the movements of the constituent members described above, the progress of the packaging and the like are arranged, and detection signals from the detection sensors are transmitted to the operation control means 17.

Then, the operation control means 17 controls, based on the results of detection of the detection sensors, the operations of the pusher member 10, the locating means 11, the pair of left and right upper gusset nails 12H, 12H, the pair of left and right intermediate gusset nails 12M, 12M, the pair of left and right lower gusset nails 12L, 12L, the blade-equipped sealing device 13, the bag supplying means 14, the article-to-be-packaged supplying means 15, the ejection means 16 and the unit main body 20. The control method of the operation control means 17 will be described in detail below.

The operation (action) of the automatic filling and packaging device 1 according to the embodiment of the present invention, that is, the control method of the operation control means 17 will then be described based on FIGS. 11 to 14 also with reference to FIG. 1 as necessary. The operations of the unit main body 20 and the pusher member 10 other than the bag supplying means 14 and the article-to-be-packaged supplying means 15 will be described in detail below.

Figure 11:
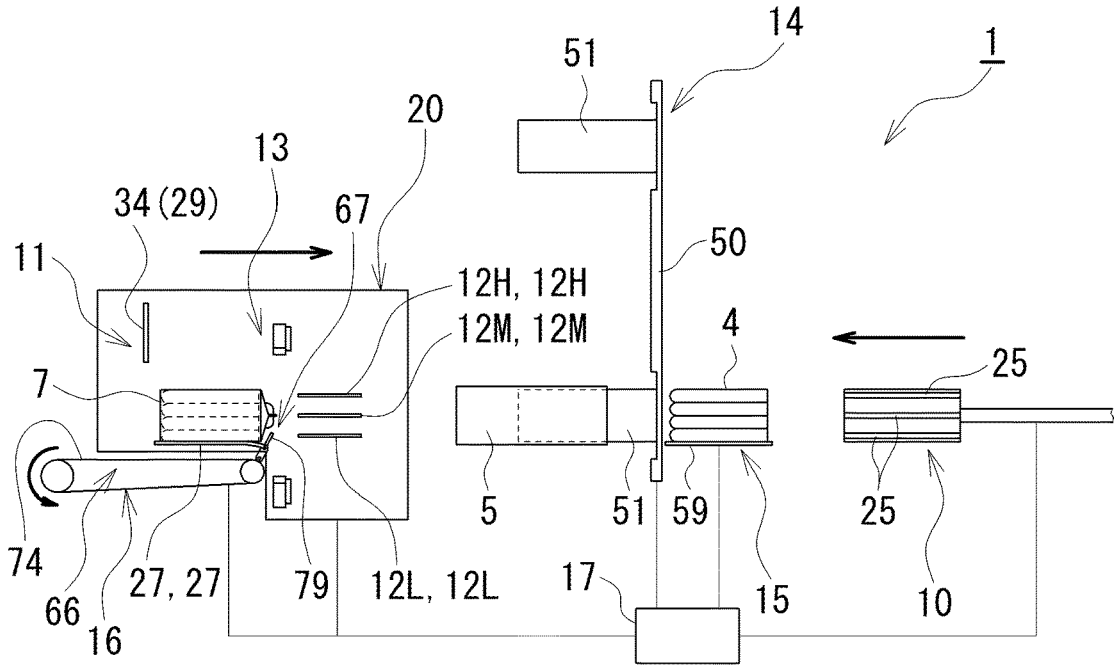
FIG. 11 is a diagram showing, in a stepwise manner, the operation of the automatic filling and packaging device according to the embodiment of the present invention.

First, the state of FIG. 11 is a state where the unit main body 20 separates from the bag supplying means 14 and moves backward to the initial position. Here, the pair of base plates 27, 27, in the locating means 11 included in the unit main body 20 and the ejection main body 66 of the ejection means 16 overlap each other in the up/down direction. In the state of FIG. 11, on the pair of base plates 27, 27, in the locating means 11 included in the unit main body 20, the article 7 is placed in which the article to be packaged 4 is filled into the packaging bag 5 and in which the opening end portion thereof is sealed.

Here, in the locating means 11, the pair of side guide plates 28, 28 (see FIG. 1) move backward to the initial position separate from the article 7, and the stopper portion 34 of the stopper member 29 also moves backward to the initial position separate from the article 7. In the ejection means 16, the stopper portion 79 of the stopper member 67 is protruded upward from the ejection main body 66. The pair of left and right upper gusset nails 12H, 12H, the pair of left and right intermediate gusset nails 12M, 12M, and the pair of left and right lower gusset nails 12L, 12L are on standby in the initial position. The bag supplying means 14 is on standby in a state where the packaging bag 5 is wrapped, from the opening end portion thereof, around the bag supporting member 51 located in the lower position. The article-to-be-packaged supplying means 15 is on standby in a state where the receiving member 59 receives the article to be packaged 4 and the article to be packaged 4 is raised to a position opposite the pusher member 10. The pusher member 10 is on standby in a state where the pusher member 10 moves backward to the initial position.

Then, from the state of FIG. 11, as shown in FIG. 12, the unit main body 20 moves forward and the pusher member 10 moves forward such that the unit main body 20 and the pusher member 10 are brought close to each other. When the unit main body 20 first moves forward, the pair of base plates 27, 27, in the locating means 11 move forward. However, here, since the stopper portion 79 of the stopper member 67 in the ejection means 16 is protruded upward from the ejection main body 66, the stopper portion 79 of the stopper member 67 regulates the movement of the article 7 on the pair of base plates 27, 27 in the same direction as the unit main body 20. Hence, as the pair of base plates 27, 27 move forward, the article 7 moves, by its weight, from the top of the base plates 27, 27 to the top of the ejection main body 66 in the ejection means 16 accordingly. Thereafter, the article 7 is guided in the direction of ejection by the rotation of the ejection belts 74, 74 in the ejection means 16.

While the unit main body 20 moves forward the maximum distance and thereafter moves backward to the initial position, the stopper portion 79 of the stopper member 67 is located below the ejection main body 66, and the stopper portion 79 of the stopper member 67 is protruded upward from the ejection main body 66 when the unit main body 20 moves backward to the initial position. Even in a state where the stopper portion 79 of the stopper member 67 is protruded upward from the ejection main body 66, since the shaft portion 78 of the stopper member 67 is arranged in the space portion 30 between the pair of base plates 27, 27 in the locating means 11 to freely relatively move, the shaft portion 78 does not prevent the forward movement of the unit main body 20 (pair of base plates 27, 27).

On the other hand, when the pusher member 10 moves forward, the pusher member 10 moves forward while pushing the article to be packaged 4 on the receiving member 59 of the article-to-be-packaged supplying means 15, the pusher member 10 pushes the article to be packaged 4 into the packaging bag 5 through the turning member 50 and the bag supporting member 51 of the bag supplying means 14 to separate the packaging bag 5 from the bag supporting members 51 and the article to be packaged 4 is guided as the temporarily packaged article 6 onto the pair of base plates 27, 27, in the locating means 11 of the unit main body 20 that moves forward. Substantially at the same time, the stopper portion 34 of the stopper member 29 in the locating means 11 moves to a position in contact with the bottom surface (surface on the downstream side) of the temporarily packaged article 6 so as to regulate the further movement of the temporarily packaged article 6 caused by the pusher member 10. The pair of side guide plates 28, 28, in the locating means 11 move close to each other to support the temporarily packaged article 6 from both the side surfaces, and thus the temporarily packaged article 6 is located on the pair of base plates 27, 27. Substantially at the same time when the unit main body 20 and the pusher member 10 move forward the maximum distance and thus the article to be packaged 4 is filled into the packaging bag 5 with the pusher member 10, the packaging bag 5 is wrapped, from the opening end portion thereof, around the bag supporting member 51 located in the upper position of the turning member 50 with the unillustrated bag fitting means.

When as described above, the unit main body 20 and the pusher member 10 move forward the maximum distance and thus pusher member 10 pushes the article to be packaged 4 into the packaging bag 5, also with reference to FIG. 8A, in both the side surfaces of the pusher member 10, the pair of left and right upper gusset nails 12H, 12H are held in the clearance grooves 25, 25 in the upper portion thereof, and in both the side surfaces of the pusher member 10, the pair of left and right lower gusset nails 12L, 12L are held in the clearance grooves 25, 25 in the lower position thereof. Here, while the pusher member 10 is present within the packaging bag 5, the pair of left and right upper gusset nails 12H, 12H, and the pair of left and right lower gusset nails 12L, 12L are inserted into the four corners of the opening end portion of the packaging bag 5. Then, by the pair of left and right upper gusset nails 12H, 12H, and the pair of left and right lower gusset nails 12L, 12L, the opening end portion of the packaging bag 5 is retained in the substantially rectangular open posture from the inside.

Figure 13:
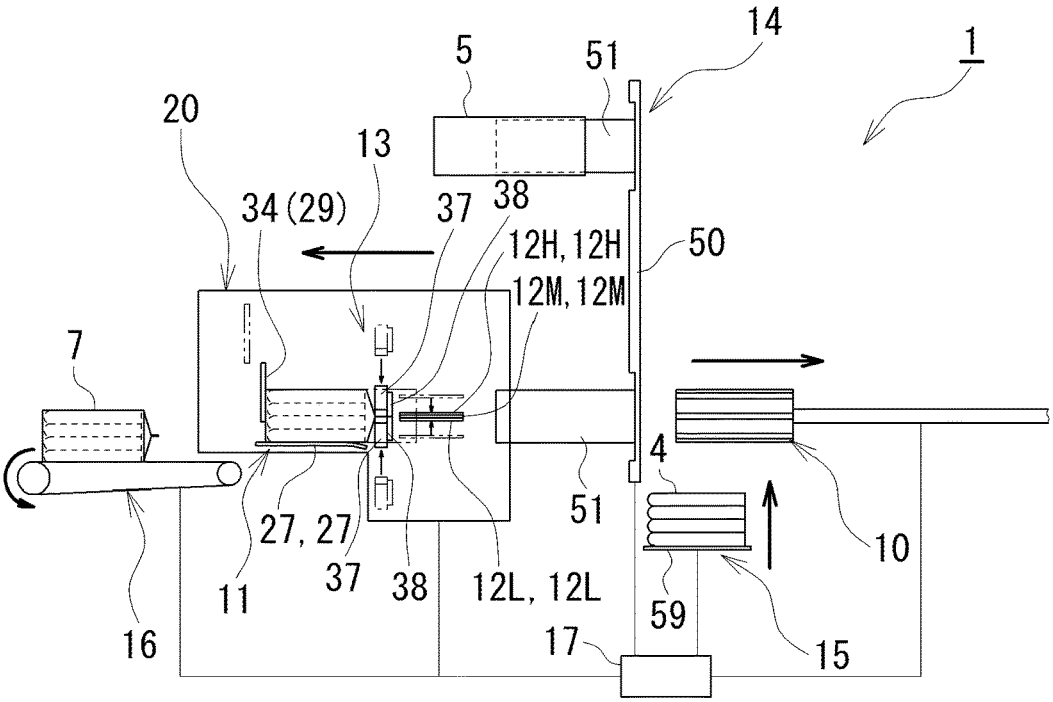
FIG. 13 is a diagram showing, in a stepwise manner, the operation of the automatic filling and packaging device according to the embodiment of the present invention.

Then, when as shown in FIG. 13, the article to be packaged 4 is filled into the packaging bag 5 with the pusher member 10 and thereafter the pusher member 10 completely moves backward from the interior of the packaging bag 5, also with reference to FIG. 8B, the pair of left and right intermediate gusset nails 12M, 12M are arranged in the vicinity of both the side surfaces of the opening end portion which is opened in a substantially rectangular shape and the center portions in the up/down direction, and move close to each other from the positions described above, and the pair of left and right upper gusset nails 12H, 12H, and the pair of left and right lower gusset nails 12L, 12L are brought close to each other to move to positions substantially overlapping the pair of left and right intermediate gusset nails 12M, 12M along the horizontal direction. Consequently, the opening end portion of the packaging bag 5 is folded into the gusset shape. Thereafter, the pusher member 10 moves backward through the bag supporting member 51 including the turning member 50 to the initial position.

On the other hand, as shown in FIG. 13, the unit main body 20 folds the opening end portion of the temporarily packaged article 6 into the gusset shape with the pair of left and right upper gusset nails 12H, 12H, the pair of left and right intermediate gusset nails 12M, 12M, and the pair of left and right lower gusset nails 12L, 12L, and thereafter starts to move backward while retaining the state described above. Then, while the unit main body 20 is moving backward, in the opening end portion of the temporarily packaged article 6 folded into the gusset shape, the part of the temporarily packaged article 6 on the downstream side with respect to the tips of the pair of left and right upper gusset nails 12H, 12H, the pair of left and right intermediate gusset nails 12M, 12M, and the pair of left and right lower gusset nails 12L, 12L is sandwiched between the pair of upper and lower sealing main bodies 37 in the blade-equipped sealing device 13 and is pressed and heated to be sealed.

Substantially at the same time, the pair of upper and lower cutter members 38, 38 in the blade-equipped sealing device 13 are brought close to each other to intersect each other, and thereby cut the extra portion on the tip side from the sealed part of the article 7. The extra portion on the tip side which is cut is removed from the pair of left and right upper gusset nails 12H, 12H, the pair of left and right intermediate gusset nails 12M, 12M, and the pair of left and right lower gusset nails 12L, 12L, and is sucked with the suction nozzle 40 (see FIG. 6) to be ejected to the outside. In this way, while the unit main body 20 moves backward to return to the initial position, the opening end portion of the temporarily packaged article 6 folded into the gusset shape can be sandwiched between the pair of upper and lower sealing main bodies 37, 37, in the blade-equipped sealing device 13 to be pressed and heated.

Figure 14:
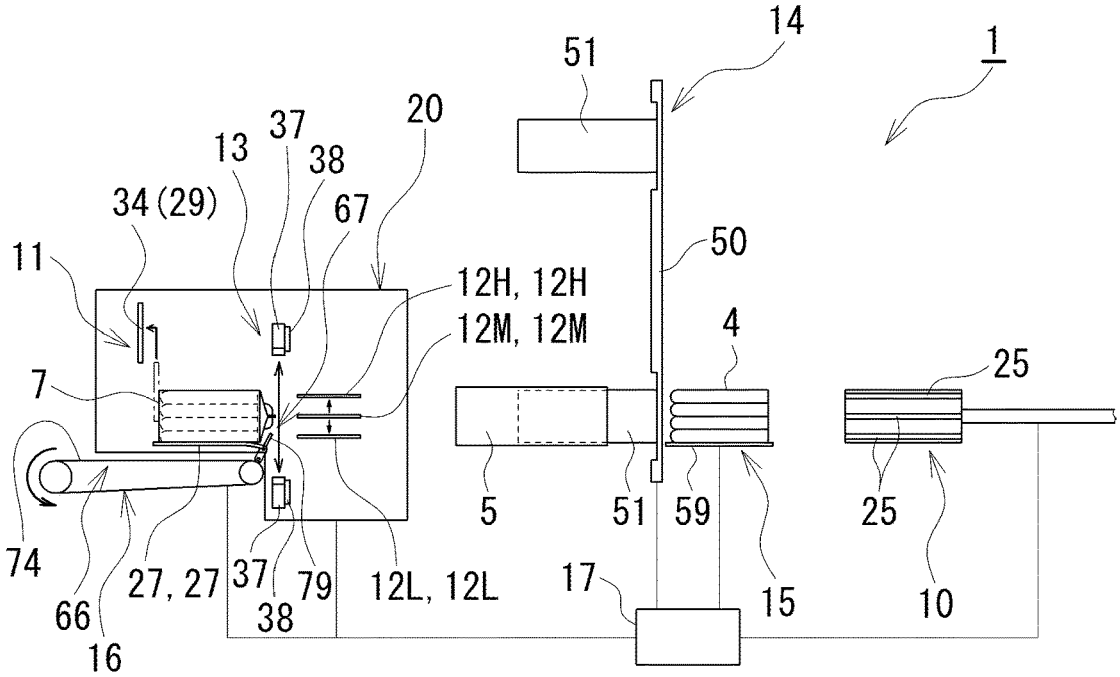
FIG. 14 is a diagram showing, in a stepwise manner, the operation of the automatic filling and packaging device according to the embodiment of the present invention.

Then, when as shown in FIG. 14, the unit main body 20 moves backward to the initial position, the packaged article 7 is placed on the pair of base plates 27, 27 in the locating means 11. Here, as in the state of FIG. 11, the locating means 11, the pair of left and right upper gusset nails 12H, 12H, the pair of left and right intermediate gusset nails 12M, 12M, the pair of left and right lower gusset nails 12L, 12L, and the blade-equipped sealing device 13 which are included in the unit main body 20 return to the initial positions. The pusher member 10 also moves backward to the initial position. In the bag supplying means 14, the turning member 50 is turned half a revolution in the forward or reverse direction, and thus the bag supporting member 51 wrapped with the packaging bag 5 is located in the lower position. In the article-to-be-packaged supplying means 15, the receiving member 59 on which the article to be packaged 4 is placed is raised to the position opposite the pusher member 10. On the other hand, here, in the ejection means 16, the stopper portion 79 of the stopper member 67 is protruded upward from the ejection main body 66 of the ejection means 16.

Thereafter, when the unit main body 20 moves forward again together with the pusher member 10, the operation described above is repeated (see FIGS. 12 to 14). Then, the operation described above is repeated, and thus the article to be packaged 4 is filled into the packaging bag 5, and the articles 7 in which the opening end portion of the packaging bag 5 is sealed into the gusset shape sequentially move from the unit main body 20 to the ejection means 16 to be guided in the direction of ejection with the ejection means 16.

As described above, in the automatic filling and packaging device 1 according to the embodiment of the present invention, the locating means 11, the pair of left and right upper gusset nails 12H, 12H, the pair of left and right intermediate gusset nails 12M, 12M, the pair of left and right lower gusset nails 12L, 12L, and the blade-equipped sealing device 13 are formed into a unit as the unit main body 20, and the unit main body 20 and the pusher member 10 are formed to be able to freely move close to and apart from each other along the horizontal direction. In this way, in the process in which the unit main body 20 and the pusher member 10 are brought close to and apart from each other, it is possible to perform a series of working steps of filling the article to be packaged 4 into the packaging bag 5, folding the opening end portion of the packaging bag 5 into the gusset shape and sealing the part thereof.

Consequently, as compared with the conventional automatic filling and packaging device, it is possible to reduce the total time in which one article to be packaged 4 is filled into one packaging bag 5 and then the opening end portion thereof is sealed so as to enhance the efficiency of packaging work. When the opening end portion of the packaging bag 5 is folded into the gusset shape, the pair of left and right upper gusset nails 12H, 12H, the pair of left and right intermediate gusset nails 12M, 12M, and the pair of left and right lower gusset nails 12L, 12L are adopted, and thus variations in the finish of the sealed portion are suppressed as compared with the conventional automatic filling and packaging device, with the result that it is possible to achieve satisfactory yield.

In the automatic filling and packaging device 1 according to the embodiment of the present invention, the direction of movement of the unit main body 20 and the direction of movement of the pusher member 10 are on the same line. In this way, it is possible to simplify the working steps in the automatic filling and packaging device 1 and to increase the speed of production of the automatic filling and packaging device 1.

Furthermore, in the automatic filling and packaging device 1 according to the embodiment of the present invention, when the unit main body 20 and the pusher member 10 move close to each other, the article to be packaged 4 is pushed from the opening end portion of the packaging bag 5 with the pusher member 10 to be filled thereinto. On the other hand, when the unit main body 20 and the pusher member 10 move apart from each other, the opening end portion of the packaging bag 5 folded into the gusset shape is sealed with the blade-equipped sealing device 13 while the unit main body 20 is moving backward. In this way, for example, even when a high-speed operation is performed, the blade-equipped sealing device 13 can take enough time to perform the sealing, and thus it is possible to suppress the occurrence of a failure in the sealing, with the result that it is possible to achieve satisfactory yield.

As described above, in the automatic filling and packaging device 1 according to the embodiment of the present invention, the three steps, that is, the step of filling the article to be packaged 4 into the packaging bag 5 while the blade-equipped sealing device 13 is opening the packaging bag 5 and locating the article to be packaged 4 in its state, the step of folding the opening end portion of the packaging bag 5 into the gusset shape and the step of sealing the folded part and performing cutting are performed while the unit main body 20 and the pusher member 10 are moving. In this way, it is possible to significantly reduce the total time in which one article to be packaged 4 is filled into one packaging bag 5 and then the opening end portion thereof is sealed so as to further enhance the efficiency of packaging work. Furthermore, even when a high-speed operation is performed, since the occurrence of a failure in the sealing is suppressed, satisfactory yield is achieved, and thus the efficiency of packaging work is further enhanced, with the result that it is possible to enhance reliability in the packaging work.

In short, in the automatic filling and packaging device 1 according to the embodiment of the present invention, as compared with the conventional automatic filling and packaging device, a step of ejecting the article is not included, that is, the step of ejecting the packaged article which includes a large number of uncertain factors for achieving the high-speed operation is separated from the step in which the blade-equipped sealing device 13 is operated, and thus as compared with the conventional automatic filling and packaging device, it is possible to significantly reduce the total time in which one article to be packaged 4 is filled into one packaging bag 5 and then the opening end portion thereof is sealed, with the result that it is possible to easily cope with an increase in the speed of the operation and to suppress the occurrence of a failure such as a failure in the sealing.

Furthermore, in the automatic filling and packaging device 1 according to the embodiment of the present invention, the outside shape of the pusher member 10 is substantially formed in the shape of a rectangular parallelepiped, and in both the side surfaces of the pusher member 10 in the direction in which the pusher member 10 moves forward and backward, the clearance grooves 25, 25, that hold the pair of left and right upper gusset nails 12H, 12H, and the pair of left and right lower gusset nails 12L, 12L are formed in the entire areas in the direction in which the pusher member 10 moves forward and backward. In this way, while the pusher member 10 is present within the packaging bag 5, the pair of left and right upper gusset nails 12H, 12H, and the pair of left and right lower gusset nails 12L, 12L can be inserted into the opening end portion of the packaging bag 5. Consequently, by the pair of left and right upper gusset nails 12H, 12H, and the pair of left and right lower gusset nails 12L, 12L, the opening end portion of the packaging bag 5 can easily be retained in a substantially rectangular open posture.

Furthermore, the automatic filling and packaging device 1 according to the embodiment of the present invention includes the ejection means 16 that ejects, from the unit main body 20, the article 7 in which the article to be packaged 4 is filled into the packaging bag 5 and in which the opening end portion thereof is sealed, and the ejection main body 66 of the ejection means 16 is arranged to overlap the pair of base plates 27, 27, in the locating means 11 of the unit main body 20 in the up/down direction when the unit main body 20 moves backward to the initial position. In this way, when the unit main body 20 moves backward to the initial position, the article 7 retained in the unit main body 20 can easily be moved, by its weight, onto the ejection main body 66 of the ejection means 16. Hence, it is not necessary to provide a new movement means or the like for moving the article 7 from the unit main body 20 to the ejection means 16, and thus the structure thereof can be simplified. In this way, in the process in which the unit main body 20 and the pusher member 10 are brought close to and apart from each other, while a series of working steps of filling the article to be packaged 4 into the packaging bag 5, folding the opening end portion of the packaging bag 5 into the gusset shape and sealing the part thereof are being performed, the packaged article 7 can be separated from the unit main body 20 simultaneously in parallel, with the result that it is possible to cope with an increase in the speed of the operation.

Furthermore, in the automatic filling and packaging device 1 according to the embodiment of the present invention, the ejection means 16 includes the stopper member 67 which regulates the movement of the article 7 when the unit main body 20 moves forward. In this way, when the unit main body 20 moves forward, in synchronization with the forward movement, the article 7 can easily be separated with the stopper member 67 from the unit main body 20 to move to the ejection means 16.

Furthermore, in the automatic filling and packaging device 1 according to the embodiment of the present invention, the opening end portion of the packaging bag 5 is supported in a substantially rectangular open posture with the pair of left and right upper gusset nails 12H, 12H, and the pair of left and right lower gusset nails 12L, 12L after the pusher member 10 moves forward to fill the article to be packaged 5 into, 12L, 12L, the packaging bag 5 before the pusher member 10 completely moves backward from the packaging bag 5. Consequently, the open posture of the opening end portion of the packaging bag 5 can easily be formed into a substantially rectangular shape along the front shape (substantially rectangular shape) of the pusher member 10. In this way, it is easy to use the pair of left and right upper gusset nails 12H, 12H, and the pair of left and right lower gusset nails 12L, 12L to form and retain the open posture in a substantially rectangular shape.

Furthermore, in the automatic filling and packaging device 1 according to the embodiment of the present invention, the opening end portion of the packaging bag 5 is folded into the gusset shape with the pair of left and right upper gusset nails 12H, 12H, the pair of left and right intermediate gusset nails 12M, 12M, and the pair of left and right lower gusset nails 12L, 12L. Consequently, as compared with the conventional technique in which in order to fold an opening end portion into a gusset shape, a large number of suction holes provided in a pusher member and a suction line including an air supply source connected to the suction holes are provided, the processing cost of the pusher member can be reduced, and the suction line is not needed, with the result that facility costs as a whole can be reduced.

REFERENCE SIGNS LIST

1: automatic filling and packaging device, 4: article to be packaged, 5: packaging bag, 6: temporarily packaged article.

7: article, 10: pusher member, 11: locating means, 12H: upper gusset nail, 12M: intermediate gusset nail, 12L: lower gusset nail, 13: blade-equipped sealing device, 16: ejection means, 17: operation control means, 20: unit main body, 25: clearance groove, 67: stopper member, 79: stopper portion

The invention claimed is:

1. An automatic filling and packaging device comprising:

a pusher member that fills an article to be packaged from an opening end portion of a packaging bag while pushing the article to be packaged;

a locating means that locates the article to be packaged in a state where the article to be packaged is filled into the packaging bag with the pusher member;

a plurality of gusset nails that fold the opening end portion of the packaging bag into a gusset shape after the article to be packaged is filled into the packaging bag with the pusher member; and a blade-equipped sealing device that cuts an extra portion of the packaging bag on a tip side while sealing the portion folded with the gusset nails into the gusset shape, wherein the locating means, the gusset nails and the blade-equipped sealing device are formed into a unit as a unit main body, the unit main body and the pusher member are formed to be able to freely move close to and apart from each other, and an operation control means configured to control to fold the opening end portion of the packaging bag into the gusset shape by the gusset nails when the pusher member completely moves backward from the interior of the packaging bag in the process in which the gusset nails of the unit main body and the pusher member are apart from each other.

2. The automatic filling and packaging device according to claim 1, wherein a direction of movement of the unit main body and a direction of movement of the pusher member are on the same line.

3. The automatic filling and packaging device according to claim 1, comprising:

the operation control means includes a control logic that performs control such that when the unit main body and the pusher member move close to each other, the article to be packaged is pushed and filled with the pusher member from the opening end portion of the packaging bag whereas when the unit main body and the pusher member move apart from each other, the opening end portion of the packaging bag folded into the gusset shape is sealed with the blade-equipped sealing device while the unit main body is moving backward.

4. The automatic filling and packaging device according to claim 3, wherein the operation control means includes the control logic that supports, with the gusset nails, the opening end portion of the packaging bag in a substantially rectangular open posture after the pusher member moves forward to fill the article to be packaged into the packaging bag before the pusher member completely moves backward from the packaging bag.

5. The automatic filling and packaging device according to claim 1, wherein an outside shape of the pusher member is substantially formed in a shape of a rectangular parallelepiped, and in both side surfaces of the pusher member in a direction in which the pusher member moves forward and backward, clearance grooves that hold the gusset nails are formed in entire areas in the direction in which the pusher member moves forward and backward.

6. The automatic filling and packaging device according to claim 1, comprising:

an ejection means that is arranged to overlap the unit main body in an up/down direction when the unit main body moves backward to an initial position and that ejects, from the unit main body, an article in which the article to be packaged is filled into the packaging bag and in which the opening end portion thereof is sealed.

7. The automatic filling and packaging device according to claim 6, wherein the ejection means includes a stopper member that regulates movement of the article when the unit main body moves forward.

* * * * *